United States Patent [19]

Mickelson

[11] 4,194,099

[45] Mar. 18, 1980

[54] CONTROL PANEL OVERLAY

[75] Inventor: John A. Mickelson, Glendale Heights, Ill.

[73] Assignee: W. H. Brady Co., Milwaukee, Wis.

[21] Appl. No.: 845,301

[22] Filed: Oct. 25, 1977

[51] Int. Cl.[2] ..... H01H 9/00; H01H 13/02

[52] U.S. Cl. ..... 200/5 A; 200/159 B; 200/86 R

[58] Field of Search ..... 200/5 R, 5 A, 16 A, 200/86 R, 159 A, 159 B, 308, 314, 317; 197/98

[56] References Cited

U.S. PATENT DOCUMENTS

| | | | |
|---|---|---|---|
| 3,590,195 | 6/1971 | Driver | 200/159 B |
| 3,600,528 | 8/1971 | Leposavic | 200/5 A |
| 3,627,927 | 12/1971 | Schmitz et al. | 197/98 X |
| 3,777,222 | 12/1973 | Harris | 200/5 R |
| 3,789,167 | 1/1974 | Seeger, Jr. et al. | 200/5 A |
| 3,811,025 | 5/1974 | Bach | 200/5 A X |
| 3,860,771 | 1/1975 | Lynn et al. | 200/5 A |
| 3,898,421 | 8/1975 | Suzumura | 200/5 A X |
| 3,911,234 | 10/1975 | Kotaka | 200/86 R X |
| 3,978,297 | 8/1976 | Lynn et al. | 200/5 A |
| 3,987,259 | 10/1976 | Larson | 200/5 A |
| 3,988,551 | 10/1976 | Larson | 200/5 A |
| 3,995,126 | 11/1976 | Larson | 200/5 A |
| 4,017,697 | 4/1977 | Larson | 200/5 A |
| 4,028,509 | 6/1977 | Zurcher | 200/5 A |
| 4,035,593 | 7/1977 | Riniker | 200/5 A |
| 4,065,649 | 12/1977 | Carter et al. | 200/5 A |
| 4,066,851 | 1/1978 | White | 200/5 A |

*Primary Examiner*—Robert S. Macon

[57] ABSTRACT

A flexible touch switch in which indicia and conductive contact portions are both formed on the undersurface of a flexible overlay that is transparent with respect to the indicia.

12 Claims, 4 Drawing Figures

FIG 1
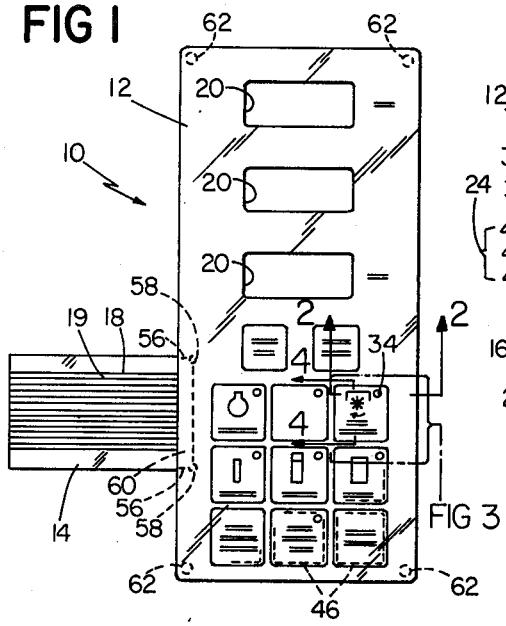
FIG 2
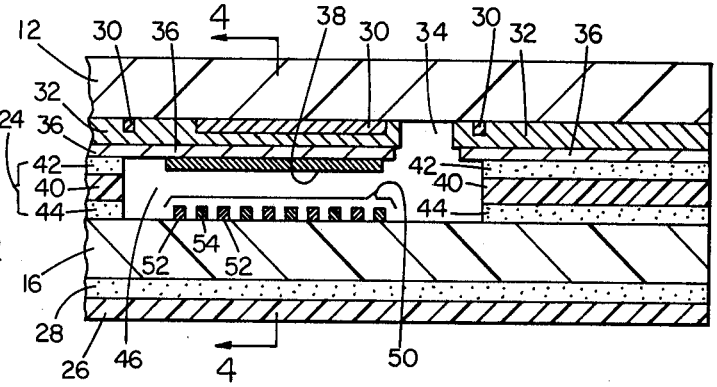
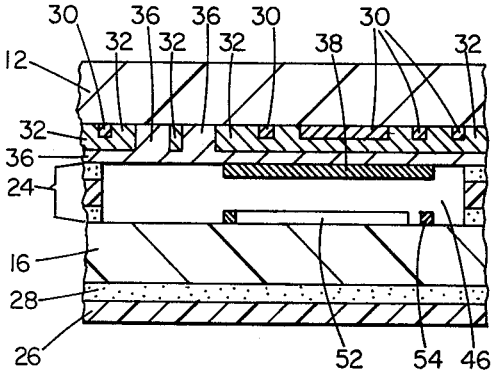
FIG 4
FIG 3
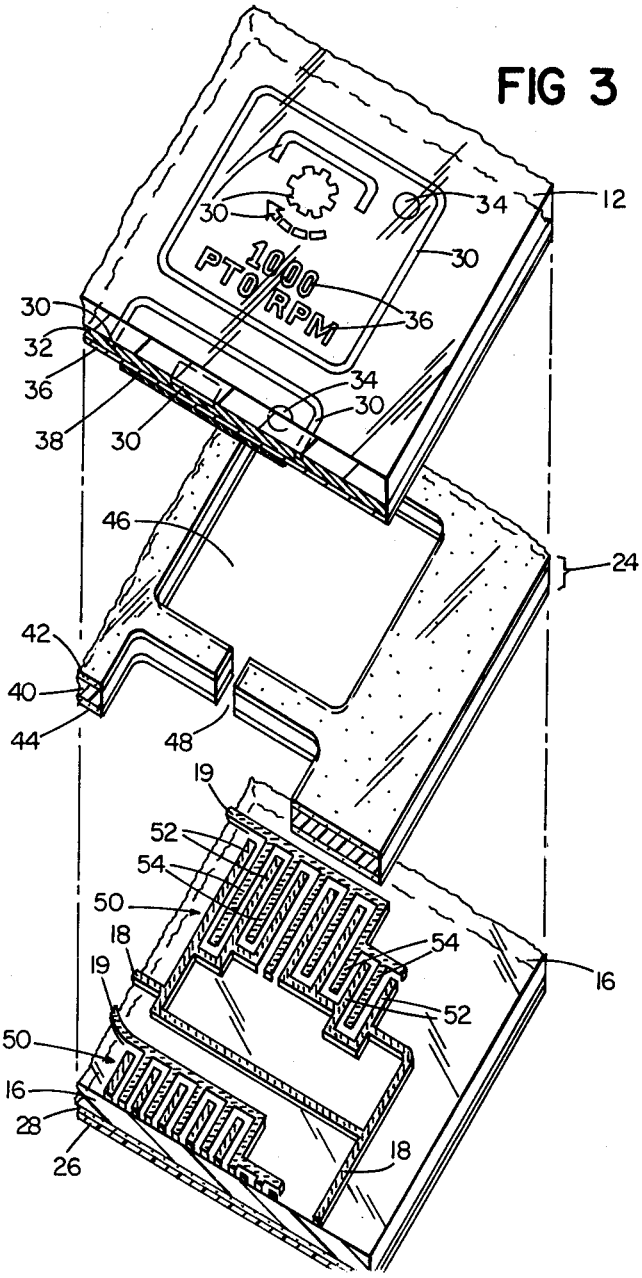

CONTROL PANEL OVERLAY

FIELD OF THE INVENTION

This invention relates to flexible electrical touch switches.

BACKGROUND OF THE INVENTION

It is desirable that the indicia overlying flexible touch switches not fade or be entirely rubbed off from frequent operation of the switches or adversely affected by exposure to the environment. It is also desirable to simplify construction.

Leposavic U.S. Pat. No. 3,600,528 and Larson U.S. Pat. No. 4,017,697 describe touch switches having very few layers, but in both the indicia are applied to the top of the overlay. Other touch switches which have relatively few layers but in which indicia are apparently applied to the switch top surface are shown in Lynn et al. U.S. Pat. No. 3,860,771 and Seeger, Jr. et al. U.S. Pat. No. 3,789,167.

Some known touch switches have indicia below the switch top surface. Schmitz et al. U.S. Pat. No. 3,627,927 teaches etching symbol designations in a conductive sheet or conductive pads adhered to the underside of a flexible insulating layer; if pads are used, etching should be done near the perimeter of each of the pads so as not to interfere with the contact area at the center of each of the pads. Bach U.S. Pat. No. 3,811,025; Lynn et al. U.S. Pat. No. 3,978,297; Driver U.S. Pat. No. 3,590,195; and Harris U.S. Pat. No. 3,777,222 all describe touch switches in which indicia are formed on the bottom or intermediate surface of a transparent overlay; however, in all these patents the indicia-carrying overlay is separate from the depressible conductive layer, as is true of Zurcher U.S. Pat. No. 4,028,509 in which metallized indicia are placed on the underside of the stylus-receiving layer for protection from the stylus.

Larson U.S. Pat. No. 3,987,259 teaches applying conductive paint to the underside of a membrane overlay.

SUMMARY OF THE INVENTION

I have discovered that a flexible touch switch of simple construction and having relatively few layers but in which indicia are protected from finger action and the environment can be provided by forming both the indicia and conductive contact portions on the same undersurface of a flexible overlay that is transparent with respect to the indicia. In a preferred embodiment the indicia and a background color are formed first on the overlay undersurface by one or more ink layers, and a conductive paint for forming the contact portions is then applied over the ink layers. The contact portions when not biased are spaced either from a conductive surface on which the switch is mounted or from a conductive substrate that can be part of the switch.

The switch of the present invention is attractive, very thin, easy to manufacture, and durable, particularly with respect to its indicia.

PREFERRED EMBODIMENT

I turn now to description of the presently preferred embodiment of the invention.

DRAWINGS

FIG. 1 is a plan view of the presently preferred embodiment of the invention;

FIG. 2 is a sectional view through 2—2 of FIG. 1;

FIG. 3 is an exploded view in perspective of a portion of the embodiment of FIG. 1; and FIG. 4 is a sectional view through 4—4 of FIG. 1.

DESCRIPTION

The embodiment shown in the drawings and its operation are now described.

1. Embodiment

FIG. 1 shows flexible switch panel 10, which is used as a control panel for monitoring the operation of a vehicle. Panel 10 includes transparent overlay 12, on the underside of which are printed white indicia including lettering, symbols, and button outlines, all then underprinted to provide a black background. Extending from the left side of panel 10 is a transparent plastic tail 14, which is integral with an extension of transparent substrate layer 16 (FIGS. 2 and 3) spaced below overlay 12. Tail 14 has printed on its upper surface in silver paint conductors 18 which lead to conductive switch portions on substrate 16 underneath each of the buttons and which are adapted to be connected at the end of the tail to other circuitry (not shown) on the vehicle. Panel 10 has three apertures 20 for viewing visual data displays when the panel is mounted in the vehicle. Panel 10 comprises a flat composite of several layers as indicated in FIGS. 2 and 3—principally overlay 12, spacer layer 24, and flexible substrate 16. There is also a liner 26 that covers adhesive 28 on the underside of substrate 16 and is removed when panel 10 is to be installed.

Overlay 12, a 10 mil thick flexible non-conductive layer of General Electric Lexan polycarbonate film, of grade 8B05 (which includes a velvet texture) and color 112, carries on its lower surface, first, a series of graphic inks with respect to which the overlay is transparent and, second, under the inks, pads of conductive paint. There are three layers of graphic ink, all of which are acrylic-based System II inks obtained from KC Coatings, Incorporated, Kansas City, Mo., and all of which are applied by screening. First applied is layer 30 of opaque white ink to form the symbols, certain of the words that are not to be backlighted, and the button outlines. Next applied is layer 32 of black ink for the panel's background color. The black ink is applied everywhere except for spaces that are left for words that are to be backlighted, such as the letters (indicia) in FIG. 3, and except for holes 34, which are left to allow red switch activation lights (not shown) underneath the panel when mounted on a vehicle to shine through to indicate when a particular button has been pushed (where uncoated with ink, overlay 12 is translucent to such lights; substrate 16 and adhesive 28 are transparent). Finally, layer 36 of translucent white ink is applied over the whole underside of overlay 12 except for holes 34 and zones defines by a small square around each hole providing an area larger than the hole, for a safety factor against paint going in it. Translucent white 36 fills indicia that can be backlighted by green light sources (not shown) underneath the panel when it is mounted on a vehicle. Each layer of ink is about 0.7 mil thick (thicker where it fills in spaces left unfilled within a preceding layer), with a total thickness for the three layers of about 2.1 mils.

Applied on translucent white layer 36 are separate pads 38 of conductive paint, each pad being about 0.7 mil thick and mostly about $\frac{5}{8}'' \times \frac{7}{8}''$ or $\frac{7}{8}'' \times \frac{7}{8}''$ in area and located underneath a particular button outline. The paint is silver paint sold by Acheson Colloids of Port Huron, Mich., under the designation Electrodag 415SS.

Spacing overlay 12 from substrate 16 is spacer layer 24, which is a Mylar (DuPont trademark) transparent polyester layer 40 having on both its surfaces a thermoset (after it is in place) acrylic transparent pressure-sensitive adhesive. Upper adhesive layer 42 is 1.5 mils thick, as is lower adhesive layer 44. Mylar layer 44 is 3 mils thick. The adhesive layers serve to bond the Mylar to overlay 12 and to substrate 16. An adhesive suitable for use in layers 42 and 44 is the 3M Company's 467 Firm Acrylic Pressure Sensitive Adhesive. Spacer layer 24 is diecut to provide contact openings (FIG. 3) underneath each button outline. Channels 48 are provided in spacer layer 24 between those contact openings 46 that are adjacent along the longitudinal dimension of panel 10. These channels serve to equalize air pressure in the longitudinally aligned openings; panel 10 overall is hermetically sealed.

Substrate 16 is a 10 mil thick flexible insulating layer of General Electric Lexan transparent polycarbonate film, grade 8030 and color 112. Deposited on its upper surface are conductive paint switch areas 50 under each of the contact openings 46. Each pattern 50 includes interfitting spaced-apart groups of fingers (about 1/16" wide and ½" long) 52 and 54. Each group of fingers is electrically isolated from the other. The fingers in each group are all joined to separate conductors 18, 19 that continue out along tail 14. Connection of any two adjacent fingers, one from each group, by pad 38, which acts as a shorting bar, closes the circuit between the conductors 18, 19 leading from each group of fingers. The paint used for the fingers 52, 54 and conductors 18 is the same as that used for pads 38 and is also 0.7 mil thick.

Underneath substrate 16 is another layer of adhesive 28, the same transparent adhesive as that used in layers 42 and 44. Transparent Mylar liner 26 covers adhesive 28 until panel 10 is ready for mounting. Both adhesive layer 28 and liner 26 are 2 mils thick.

As shown in FIG. 4, opening 46 in spacer layer 24 is wider than pad 38 (as it is in the coplanar transverse direction not shown), leaving an open space under the lettering (FIG. 3) formed by translucent white layer 36 for backlighting of the lettering, which is provided by a green light (slot and circuitry not shown) under adhesive layer 28 when it is mounted on a vehicle. The light can shine up through adhesive 28, substrate 16, translucent white lettering 36, and substrate 12.

In mounting panel 10, liner 26 is removed, and tail 14 is bent perpendicularly down from the panel, inserted through a slot on the vehicle, and connected to vehicle circuitry (slot and circuitry not shown). Two cuts 56 (FIG. 1) each about ¼ inch long in substrate 16 are made under spacer layer 24 and overlay 12 directly inwardly from tail 14, and at the end of each cut a small circular portion 58 of substrate 16 is removed to allow bending down of the tail inward of the panel edge without tearing substrate 16. Bending tail 14 down inward of the panel edge permits panel 10 to be sealed to the vehicle around the panel's entire periphery, because adhesive 28 will seal the panel to the vehicle everywhere except the space between where the tail bends and the adjacent panel edge and there adhesive 44 will complete the seal. A Mylar spacer strip 60 is placed between adhesive 44 and the portion of tail 14 under overlay 12 to prevent the tail from sticking to adhesive 44. The spacer strip is removed when the panel is installed.

Liner 26 extends out the whole length of tail 14, although adhesive 28 stops at the panel edge.

Holes 62 formed through spacer layer 24, substrate 16, adhesive layer 28, and liner 26 help to register these parts during assembly of panel 10.

2. Operation

A person selects the desired button (backlighting of certain of the lettering permits it to be read in the dark) and presses it with his finger generally in the center of the button outline. This action causes overlay 12 to be depressed, causing pad 38 to contact and bridge at least some fingers 52 and 54. This completes circuit and activates a red light under the hole 34 of the particular button pushed to indicate to the operator that he has completed the desired circuit. When pressure from the finger is removed, overlay 12 because of the memory of the polycarbonate, will return to its original position, reopening the circuit.

VARIATIONS AND MODIFICATIONS

Substrate 16 can be a rigid substrate such as a printed circuit board. In that case adhesive 28 and liner 26 will normally not be needed. If substrate 16 has an irregular upper surface, adhesive layer 44 should be 2 mils thick. Also substrate 16 need not even be included in a switch panel as made. Liner 26 could be placed directly over adhesive layer 44, and the appropriate conductive pattern could be provided on a surface of the device on which the panel is to be mounted. One would peel off liner 26 when the panel is ready to be mounted on the device surface. Furthermore spacer layer 24 need not be included in a switch panel as made but could also be provided on the surface on which the panel is to be mounted, as could any adhesive that is used to do the mounting. Spacer layer 24 could even be eliminated, as by forming domes in overlay 12 for the buttons so that spacing would be provided by the shape of the domes.

Instead of acting merely as shorting bars, conductive pads 38 could be connected to external circuitry to provide an X-Y matrix switch panel.

OTHER INVENTIONS

Using a transparent substrate and a transparent overlay to permit visual feedback by switch activation lights and backlighting of certain lettering, all at a "button" area, was the invention of Wayne K. Parkinson.

Modification of the embodiment shown to provide an X-Y matrix switch was also the invention of Wayne K. Parkinson.

The arrangement of a bend-down tail with small holes at the joints between the tail and the rest of the substrate to prevent tearing was the invention of William R. Kissner.

What is claimed is:

1. A flexible switching element adapted to be mounted on a surface having electrically conductive portions thereon, said element comprising:

a flexible overlay, said overlay having an upper surface for receiving switch activating pressure and a lower surface, a layer of ink formed on at least some portions of said overlay lower surface to provide indicia for said switching element, said overlay being transparent with respect to said indicia, and an electrically conductive layer formed on at least a portion of said overlay lower surface or ink layer lower surface for movement jointly with a respective indicium and against at least two spaced said electrically conductive portions.

2. The switching element of claim 1 further comprising:

a substrate positioned below said overlay lower surface, said substrate providing said surface having electrically conductive portions thereon, and means for spacing said electrically conductive portions from said electrically conductive layer when said overlay upper surface is not biased by switch activating pressure, whereby switch activating pressure applied to said overlay upper surface will bring said conductive layer into contact with at least one of said conductive portions and release of said pressure will allow said overlay to take said conductive layer out of contact with said one of said conductive portions.

3. The switching element of claim 1 wherein said electrically conductive layer comprises a plurality of discrete spaced-apart contact portions.

4. The switching element of claim 2 wherein said substrate is flexible.

5. The switching element of claim 1 wherein said electrically conductive layer is formed on said ink layer.

6. The switching element of claim 19 wherein said contact portions are pads.

7. The switching element of claim 2 wherein each of said conductive portions on said substrate is part of a different electrical circuit and contact between said conductive layer and each of said conductive portions will complete each said different circuit.

8. The switching element of claim 1 wherein there are a plurality of ink layers formed on said overlay lower surface with at least one layer providing said indicia and at least another layer providing background color for said indicia.

9. The switching element of claim 7 wherein said indicia indicate where switch activation pressure should be applied to complete each said different circuit.

10. The switching element of claim 2 wherein said substrate is rigid.

11. The switcing element of claim 3 wherein said indicia indicate discrete button areas of said overlay and one of said contact portions is formed under each of said button areas.

12. The switching element of claim 1 wherein said electrically conductive layer is composed of conductive paint.

* * * * *

UNITED STATES PATENT AND TRADEMARK OFFICE

CERTIFICATE OF CORRECTION

PATENT NO. : 4,194,099

DATED : March 18, 1980

INVENTOR(S) : John A. Mickelson

It is certified that error appears in the above-identified patent and that said Letters Patent are hereby corrected as shown below:

Column 2, lines 58-59, "fills indicia" is changed to --fills in the spaces left untouched by the black ink (Fig. 4) to form indicia--.

Column 3, line 8, "Mylar layer 44 is" is changed to --Mylar layer 40 is--.

Column 4, line 12, "This completes circuit and" is changed to --This completes a circuit and--.

Column 6, claim 6, line 1, "The switching element of claim 19" is changed to --The switching element of claim 3--.

Column 6, claim 11, line 18, "The switcing" is changed to --The switching--.

Column 6, claim 11, line 19, "button areas of said overlay" is changed to --button areas on said overlay--.

Signed and Sealed this

*First* Day of *July 1980*

[SEAL]

*Attest:*

SIDNEY A. DIAMOND

*Attesting Officer*

*Commissioner of Patents and Trademarks*